US011732508B1

(12) United States Patent
Salvesen

(10) Patent No.: US 11,732,508 B1
(45) Date of Patent: Aug. 22, 2023

(54) WINDOW LOCKING APPARATUS

(71) Applicant: Nathan Salvesen, Bothell, WA (US)

(72) Inventor: Nathan Salvesen, Bothell, WA (US)

(73) Assignee: Nathan Salvesen, Bothell, WA (US)

( * ) Notice: Subject to any disclaimer, the term of this patent is extended or adjusted under 35 U.S.C. 154(b) by 0 days.

(21) Appl. No.: 17/675,143

(22) Filed: Feb. 18, 2022

(51) Int. Cl.
*E06B 9/00* (2006.01)
*E05B 65/08* (2006.01)
*E06B 9/06* (2006.01)

(52) U.S. Cl.
CPC ..... *E05B 65/0888* (2013.01); *E06B 9/063* (2013.01); *E06B 2009/002* (2013.01)

(58) Field of Classification Search
CPC ..... E06B 9/01; E06B 9/02; E06B 2009/002; E06B 9/063; E06B 2009/015; E06B 2009/005; E05B 65/0888
See application file for complete search history.

(56) References Cited

U.S. PATENT DOCUMENTS 1,459,522 A * 6/1923 Woods ..... E06B 9/01 160/223
1,662,117 A * 3/1928 Kuhl ..... E06B 9/01 49/55
1,665,991 A * 4/1928 Stramaglia ..... E04G 3/18 182/60
1,723,970 A * 8/1929 Jauch ..... B66F 3/08 248/354.3
1,782,415 A * 11/1930 Farmer ..... E06B 9/01 160/374
2,103,130 A * 12/1937 Windle ..... E06B 9/01 52/106
2,755,525 A * 7/1956 Minot, Jr. ..... E06B 9/01 49/55
2,982,579 A * 5/1961 Greenwald ..... B60R 21/026 49/55
4,023,819 A * 5/1977 Holman, Jr. ..... B60P 7/15 410/151
4,149,342 A * 4/1979 Bowers ..... E06B 9/01 49/55

(Continued)

OTHER PUBLICATIONS

Removable 52 in. to 64 in. Adjustable Width 8-Bar Window Guard, White, Retrieved from Internet, Retrieved on Nov. 24, 2021 <URL: https://www.homedepot.com/p/Mr-Goodbar-Removable-52-in-to-64-in-Adjustable-Width-8-Bar-Window-Guard-White-s203-F-52-64/301452096>.

(Continued)

*Primary Examiner* — Abe Massad

(57) ABSTRACT

A window locking apparatus includes a proximal cross brace, a distal cross brace, a first track brace, and a second track brace. The first track brace is positioned parallel to the second track brace. The proximal cross brace is perpendicularly positioned in between the first track brace and the second track brace. The distal cross brace is perpendicularly positioned in between the first track brace and the second track brace, wherein the proximal cross brace and the distal cross brace are positioned offset of each other. The proximal cross brace is rotatably connected to the first track brace and removably mounted to the second track brace. The distal cross brace is rotatably connected to the first track brace and removably mounted to the second track brace. The removable connections of the second track brace allows the window locking apparatus to be installed or removed from a window.

13 Claims, 7 Drawing Sheets

(56) References Cited

U.S. PATENT DOCUMENTS 4,236,854 A * 12/1980 Rogers ..... B60P 7/15 410/151
4,615,142 A * 10/1986 Reeves ..... E06B 9/02 49/55
4,817,334 A * 4/1989 Badger ..... E06B 9/01 49/55
5,575,113 A * 11/1996 Huang ..... E06B 9/02 49/55
5,704,164 A * 1/1998 Huang ..... E06B 9/02 49/55
6,141,912 A * 11/2000 Graham ..... E06B 9/02 49/465
6,192,628 B1 * 2/2001 Pinheiro ..... B60J 1/20 160/370.21
6,233,877 B1 * 5/2001 Monroe ..... A62B 1/04 248/200.1
6,799,534 B1 * 10/2004 Wang ..... B60R 21/06 119/412
6,827,533 B2 * 12/2004 Cano-Rodriguez ..... B60P 7/15 410/127
6,830,418 B2 * 12/2004 Keramidis ..... B61D 45/006 410/151
7,231,954 B2 * 6/2007 Green ..... E01F 13/022 52/63
7,877,824 B2 * 2/2011 Grant ..... A47K 3/38 4/577.1
9,038,313 B2 5/2015 Morrone
2009/0158665 A1 * 6/2009 Wu ..... E06B 9/02 49/55

OTHER PUBLICATIONS

2pcs Casement Stay Window Latch Lock Adjustable Telescoping Casement Window Stay, Window Stopper, Window Latch, Windproof Support, Retrieved from Internet, Retrieved on Nov. 24, 2021 <URL https://www.amazon.com/Casement-Adjustable-Telescoping-Stopper-Windproof/dp/B07ZCXG72C>.

12" Casement Window Stay—Brass—Polished Nickel, Retieved from Internet, Retrieved on Nov. 24, 2021 <URL: https://www.signaturehardware.com/solid-brass-casement-window-stay.html?pids=261087&g_acctid=7220359250>.

Eudemon Window Lock Children Protection Window Restrictor Child Safety Window Stopper Falling Prevention Locks Limiter, Retrieved from Internet, Retrieved on Nov. 24, 2021 <URL: https://www.amazon.com/EUDEMON-Children-Protection-Restrictor-Prevention/dp/B07WN17G7D>.

* cited by examiner

WINDOW LOCKING APPARATUS

FIELD OF THE INVENTION

The present invention relates generally to window locking mechanisms. More specifically, the present invention is a window locking apparatus that functions as a safety mechanism to prevent intruders from breaking in and to prevent a child from a falling out.

BACKGROUND OF THE INVENTION

Window latches are the most common type of window lock that is found on most single and double hung windows when they're installed. Window latches are simple locks that should be reinforced by other locks to help fortify your window so that the window can't be opened from outside. Window latches are found on the top of a window sash to secure the two sashes together when they're both closed. When the window lock is unlocked, one or both window sashes can be opened within the window frame. However, the window latch can easily be accessed through a broken window glass by an intruder from outside or can be opened by a child from inside. In both of those scenarios, the window latch fails as a safety mechanism and can lead into an unfortunate event. Furthermore, window latches can fail overtime due to over usage, defects, or material breakdown.

It is an objective of the present invention is to provide users with a window locking apparatus that overcomes aforementioned issues of the window latches. The present invention functions as removable locking device that functions as a secondary lock for window. The present invention prevents intruders from breaking in and a child from falling out through a window in the event of a failed window latch. The present invention can be easily adjusted to any size window before installation and can be easily removed from the window in an emergency situation.

DETAIL DESCRIPTIONS OF THE INVENTION

All illustrations of the drawings are for the purpose of describing selected versions of the present invention and are not intended to limit the scope of the present invention.

Figure 1:
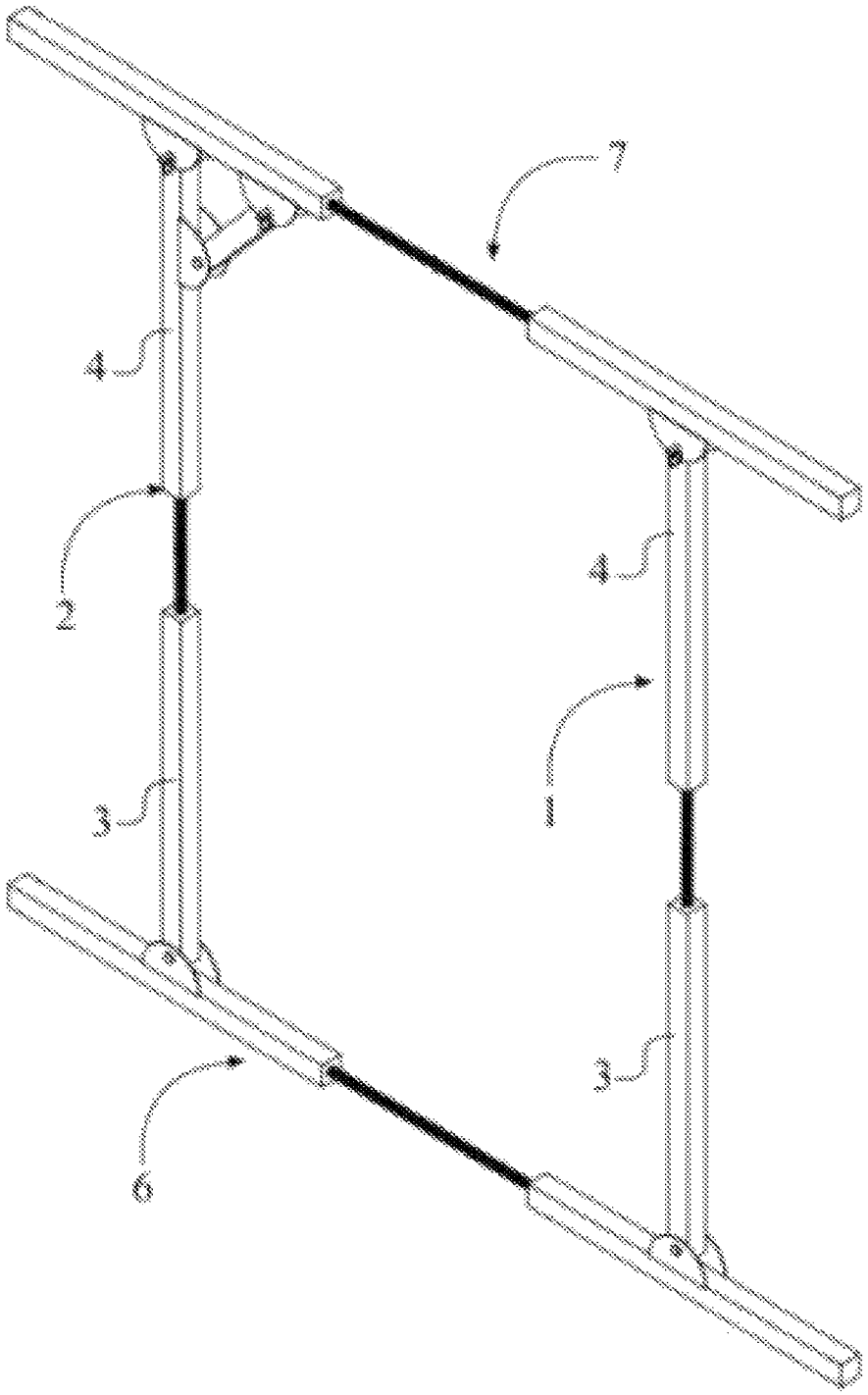
FIG. 1 is a perspective view of the present invention in the assemble configuration.

The present invention is a window locking apparatus and functions as a removable secondary lock for a window. The present invention prevents intruders from breaking in and a child from a falling out through the window in the event of a failed window latch of the window. The present invention can be easily adjusted to any size window before installation and can be easily removed from the window in an emergency situation. As shown in FIG. 1, the present invention comprises a proximal cross brace 1, a distal cross brace 2, a first track brace 6, and a second track brace 7. The proximal cross brace 1 and the distal cross brace 2 each comprises a first female tubular body 3 and a second female tubular body 4.

All illustrations of the present invention is shown with respect to a window horizontally open from left to right. More specifically, a sliding sash of the window horizontally moves along the head of the window and the sill of the window. However, the present invention can also utilize within a window, wherein the sliding sash vertically moves in between the head of the window and the sill of the window by simply rotating the present invention 90 degrees clockwise and without deviating from components and their configurations.

Figure 2:
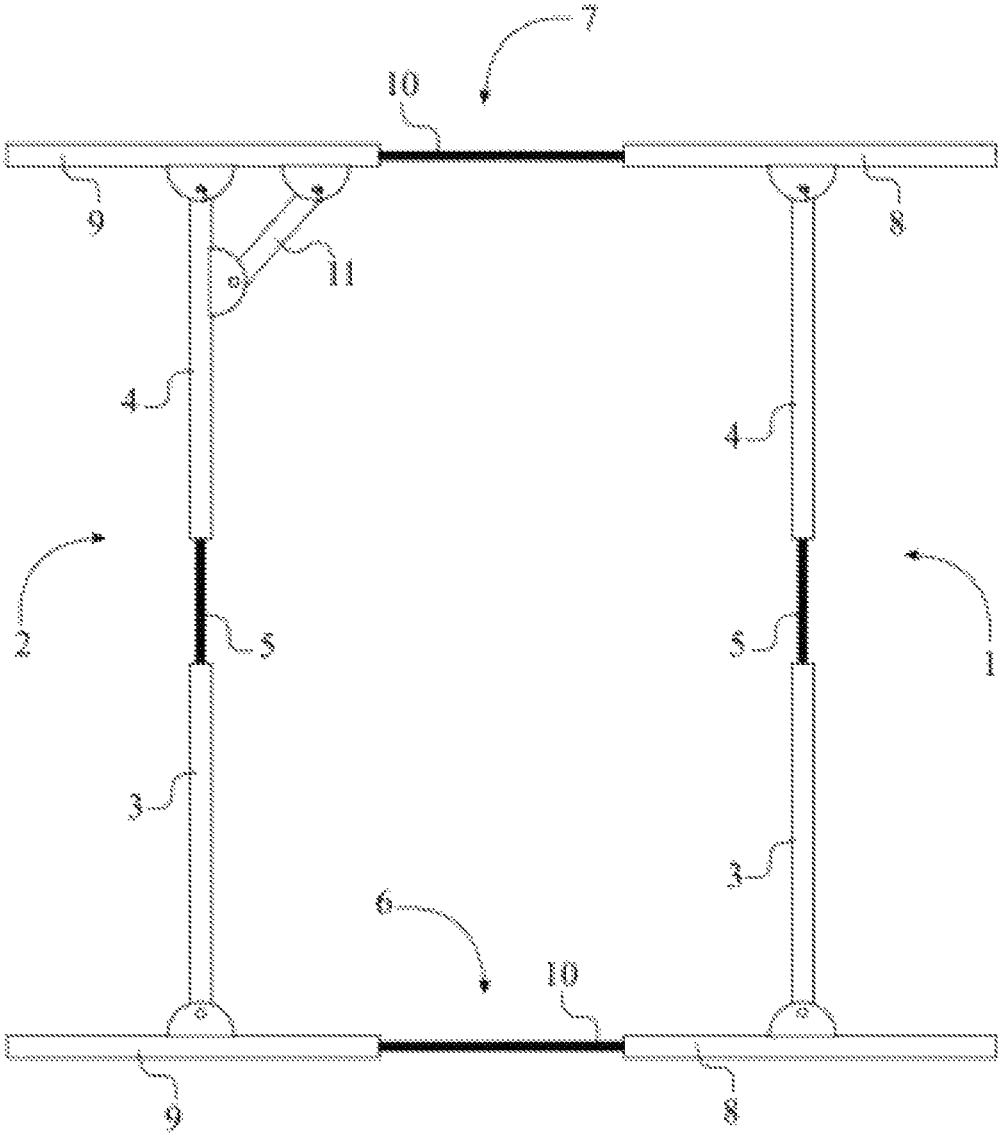
FIG. 2 is a front view of the present invention in the assemble configuration.

In reference to the general configuration of the present invention, as shown in FIG. 1-2, the first track 6 is positioned parallel to the second track brace 7 so that the first track brace 6 and the second track brace 7 can position within a window frame of the window. Due to the internal positioning within the window frame, the first track brace 6 and the second track brace 7 are able to eliminate the movement of the sliding sash. The proximal cross brace 1 is perpendicularly positioned in between the first track brace 6 and the second track brace 7 and positioned adjacent to the sliding sash. More specifically, the first female tubular body 3 of the proximal cross brace 1 is rotatably connected to the first track brace 6. The second female tubular body 4 of the proximal cross brace 1 is removably mounted to the second track brace 7. The distal cross brace 2 is perpendicularly positioned in between the first track brace 6 and the second track brace 7, wherein the proximal cross brace 1 and the distal cross brace 2 are positioned offset of each other. More specifically, the first female tubular body 3 of the distal cross brace 2 is rotatably connected to the first track brace 6. The second female tubular body 4 of the distal cross brace 2 is removably mounted to the second track brace 7. The proximal cross brace 1, the distal cross brace 2, the first track brace 6, and the second track brace 7 are able to collectively define a rectangular profile for the present invention, wherein the proximal cross brace 1 and the distal cross brace 2 apply pressure to push apart the first track brace 6 and the second track brace 7.

The first track brace 6 and the second track brace 7 prevent the sliding sash from opening within the window due to the positioning of the first track brace 6 and the second track brace 7 within the window frame. In reference to FIG. 1-2, the first track brace 6 and the second track brace 7 each comprises a proximal female tubular body 8, a distal female tubular body 9, and a threaded track-rod 10. The proximal female tubular body 8 and the distal female tubular body 9 are oppositely positioned of each other about the threaded track-rod 10. The proximal female tubular body 8 is threadedly engaged around the threaded track-rod 10. The distal female tubular body 9 is threadedly engaged around the threaded track-rod 10. More specifically, the first track brace 6 and the second track brace 7 function similar to a turnbuckle so that the user can easily adjust the overall length according to different size windows. For example, when the threaded track-rod 10 is rotated, the proximal female tubular body 8 and the distal female tubular body 9 either linearly move toward each other or move away from each other. Depending upon the orientation of the window, the actual orientation of the first track brace 6 and the second track brace 7 can differ within the window frame. More specifically, when the sliding sash vertically moves in between a head of the window and a sill of the window, the first track brace 6 is positioned within a left side of the window frame and the second track brace 7 is positioned within a right side of the window frame. When the sliding sash horizontally moves along the head of the window and the sill of the window, the first track brace 6 is positioned within a sill side of the window frame and the second track brace 7 is positioned within a head side of the window frame.

The proximal cross brace 1 and the distal cross brace 2 applies pressure to the first track brace 6 and the second track brace 7 so that the present invention can maintain the rectangular profile within the window frame. In reference to FIG. 1-2, the proximal cross brace 1 and the distal cross brace 2 each further comprising a threaded cross-rod 5 in addition to the first female tubular body 3 and the second female tubular body 4. The first female tubular body 3 and the second female tubular body 4 are oppositely positioned of each other about the threaded cross-rod 5. The first female tubular body 3 is threadedly engaged around the threaded cross-rod 5. The second female tubular body 4 being threadedly engaged around the threaded cross-rod 5. More specifically, the proximal cross brace 1 and the distal cross brace 2 function similar to a turnbuckle so that the user can easily adjust the overall length according to different size windows. For example, when the threaded cross-rod 5 is rotated, the first female tubular body 3 and the second female tubular body 4 either linearly move toward each other or move away from each other. Depending upon the orientation of the window, the actual orientation of the proximal cross brace 1 and the distal cross brace 2 can differ within the window frame. More specifically, when the sliding sash vertically moves in between the head of the Window and the sill of the window, the proximal cross brace 1 and the distal cross brace 2 are positioned from the left side of the window frame to the right side of the window frame. When the sliding sash horizontally moves along the head of the window and the sill of the window, the proximal cross brace 1 and the distal cross brace 2 are positioned from the sill side of the window frame to the head side of the window frame.

Figure 3:
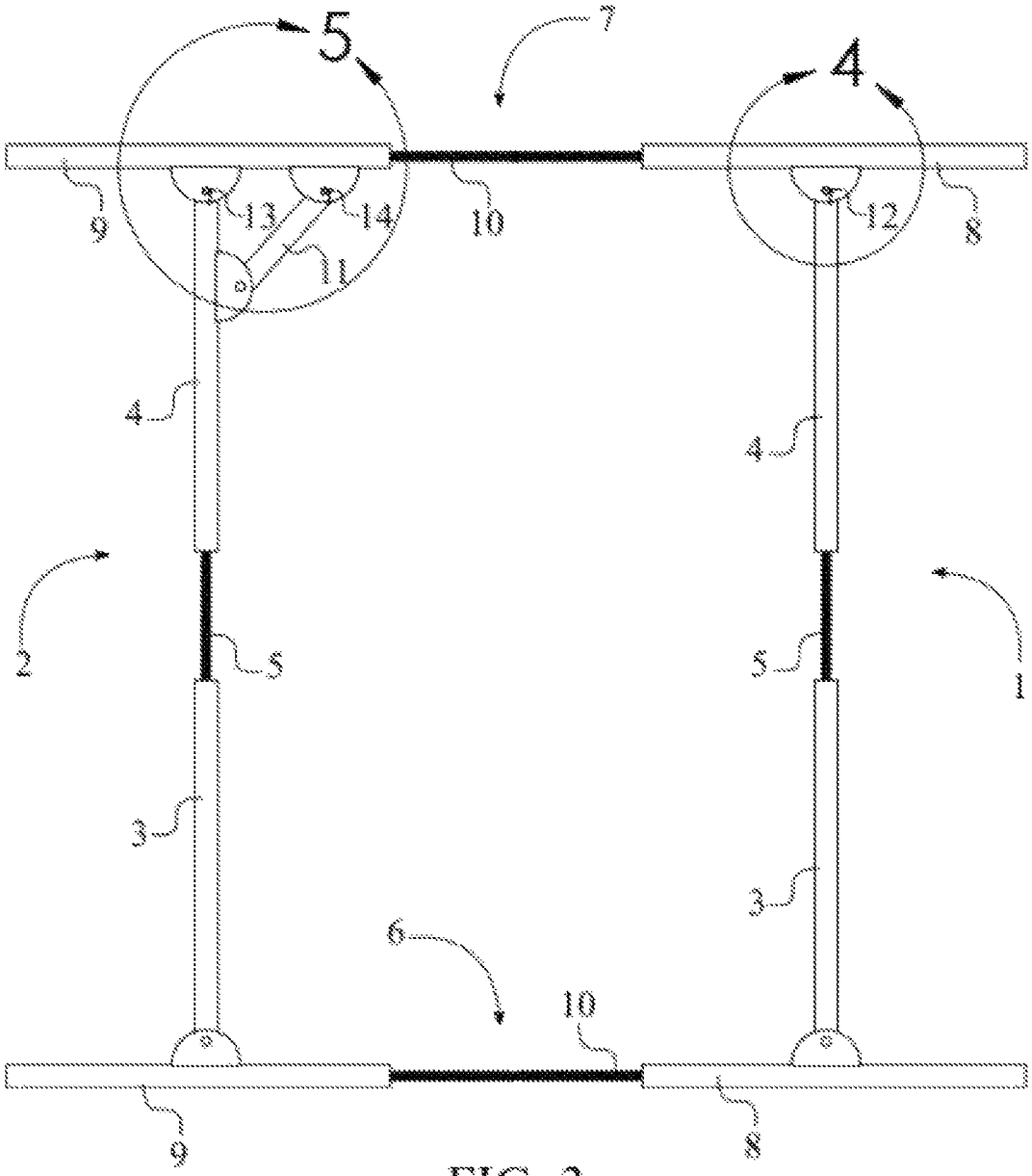
FIG. 3 is a front view of the present invention in the assemble configuration which a detailed view is taken shown in FIG. 4 and FIG. 5.
Figure 4:
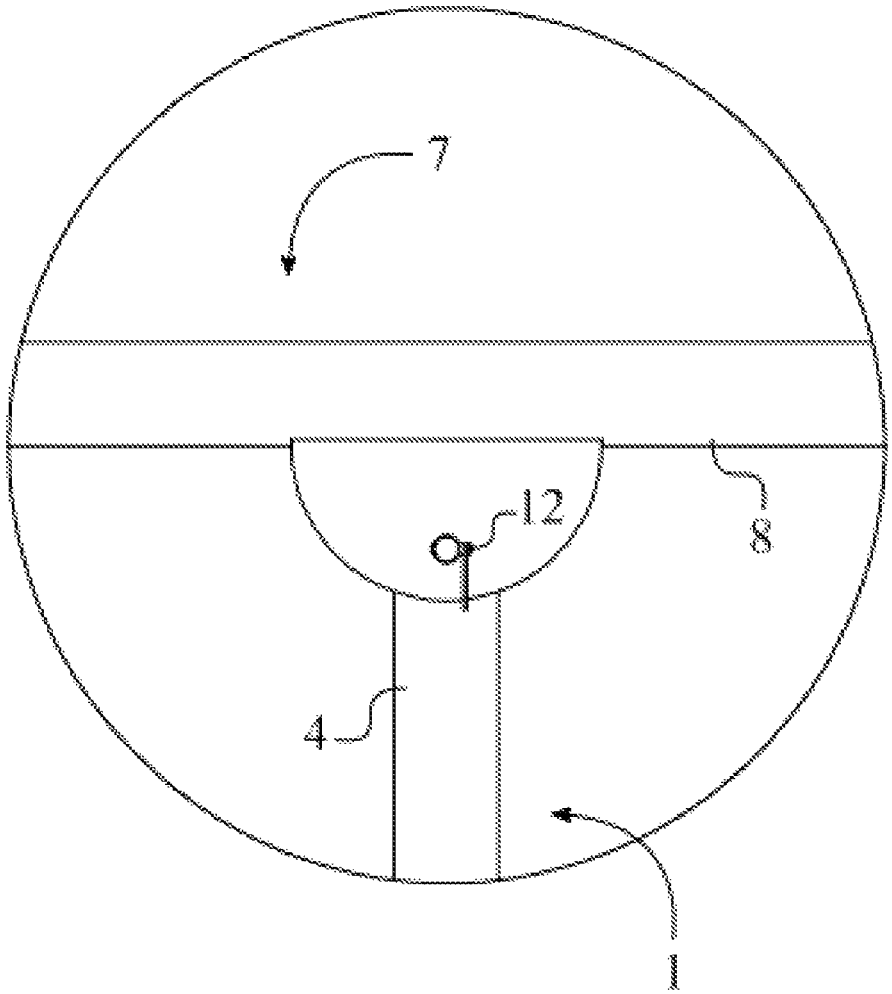
FIG. 4 is a detailed view for the present invention taken within section line 4.

In reference to FIG. 3, the first female tubular body 3 of the proximal cross brace 1 is rotatably connected to the proximal female tubular body 8 of the first track brace 6 so that the proximal cross brace 1 can rotate with respect to the first track brace 6. The second female tubular body 4 of the proximal cross brace 1 is removably mounted to the proximal female tubular body 8 of the second track brace 7 so that the first track brace 6 can be perpendicularly mounted to the second track brace 7 via the proximal cross brace 1. As a result, the proximal cross brace 1 is able to push the first track brace 6 and the second track brace 7 against the window frame. As show in FIGS. 3-4 and FIG. 6, a first locking body 12 of the present invention is utilized within the attachment between the proximal cross brace 1 and the second track brace 7. More specifically, the second female tubular body 4 of the proximal cross brace 1 is removably mounted to the proximal female tubular body 8 of the second track brace 7 by the first locking body 12. Preferably, the first locking body 12 is a connector pin so that the user can easily remove the connector pin during an emergency to disassemble the present invention.

In reference to FIG. 3, the first female tubular body 3 of the distal cross brace 2 is rotatably connected to the distal female tubular body 9 of the first track brace 6 so that the distal cross brace 2 can rotate with respect to the first track brace 6. The second female tubular body 4 of the distal cross brace 2 is removably mounted to the distal female tubular body 9 of the second track brace 7 so that the first track brace 6 can be perpendicularly mounted to the second track brace 7 via the distal cross brace 2. As a result, the distal cross brace 2 is able to push the first track brace 6 and the second track brace 7 against the window frame. As show in FIG. 3 and FIG. 5-6, a second locking body 13 of the present invention is utilized within the attachment between the distal cross brace 2 and the second track brace 7. More specifically, the second female tubular body 4 of the distal cross brace 2 is removably mounted to the distal female tubular body 9 of the second track brace 7 by the second locking body 13. Preferably, the second locking body 13 is a connector pin so that the user can easily remove the connector pin during an emergency to disassemble the present invention.

Figure 5:
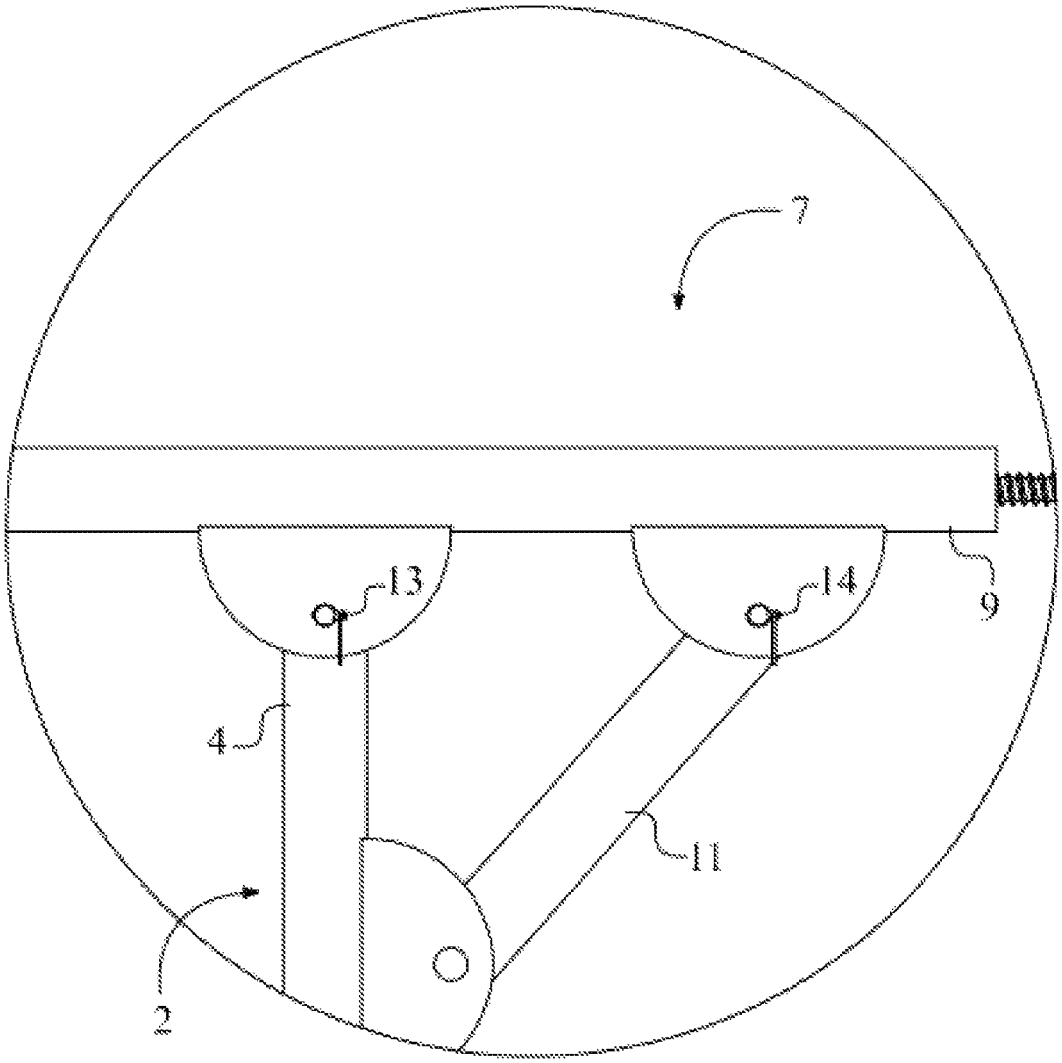
FIG. 5 is a detailed view for the present invention taken within section line 4.
Figure 6:
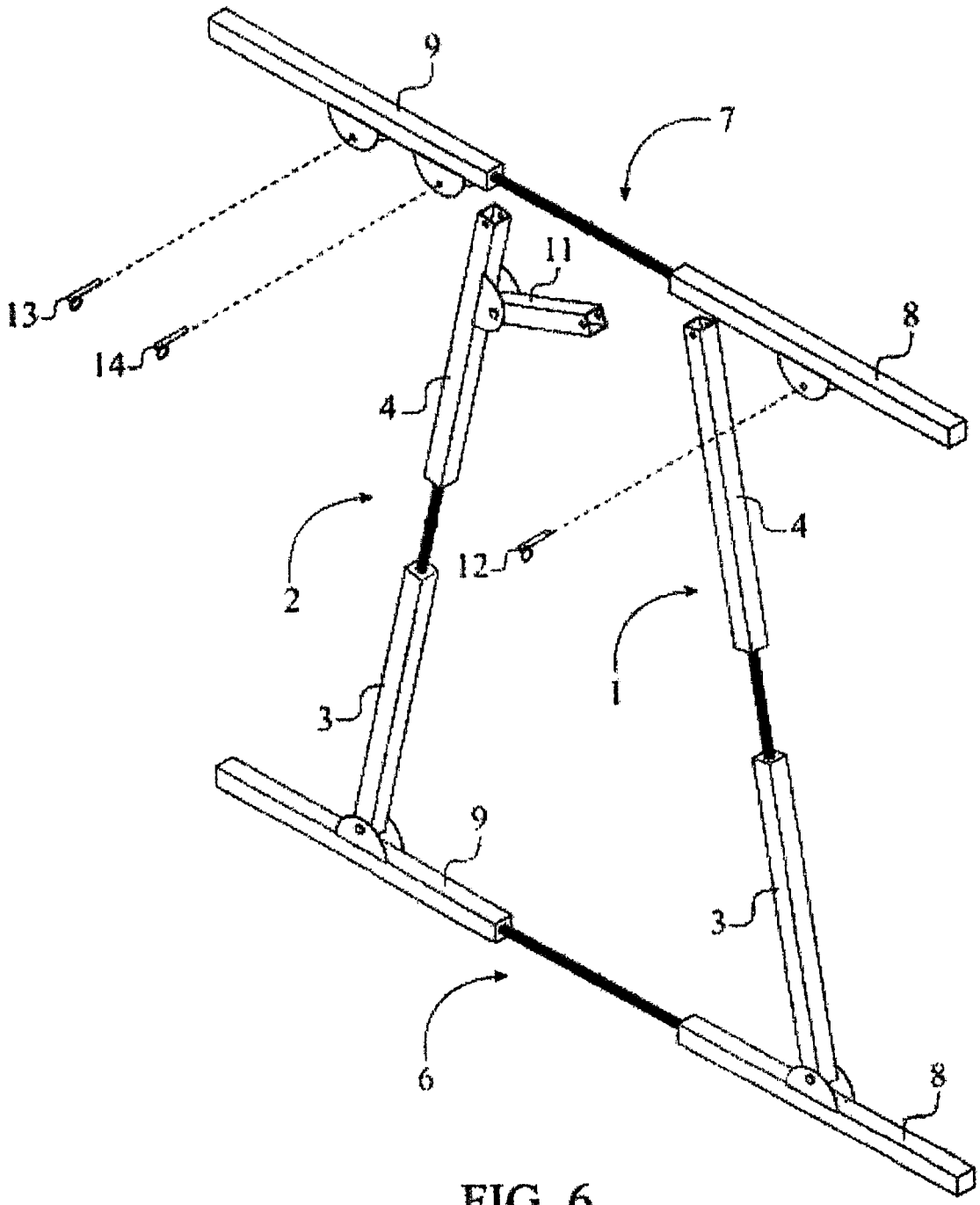
FIG. 6 is a perspective view of the present invention in the disassemble configuration.
Figure 7:
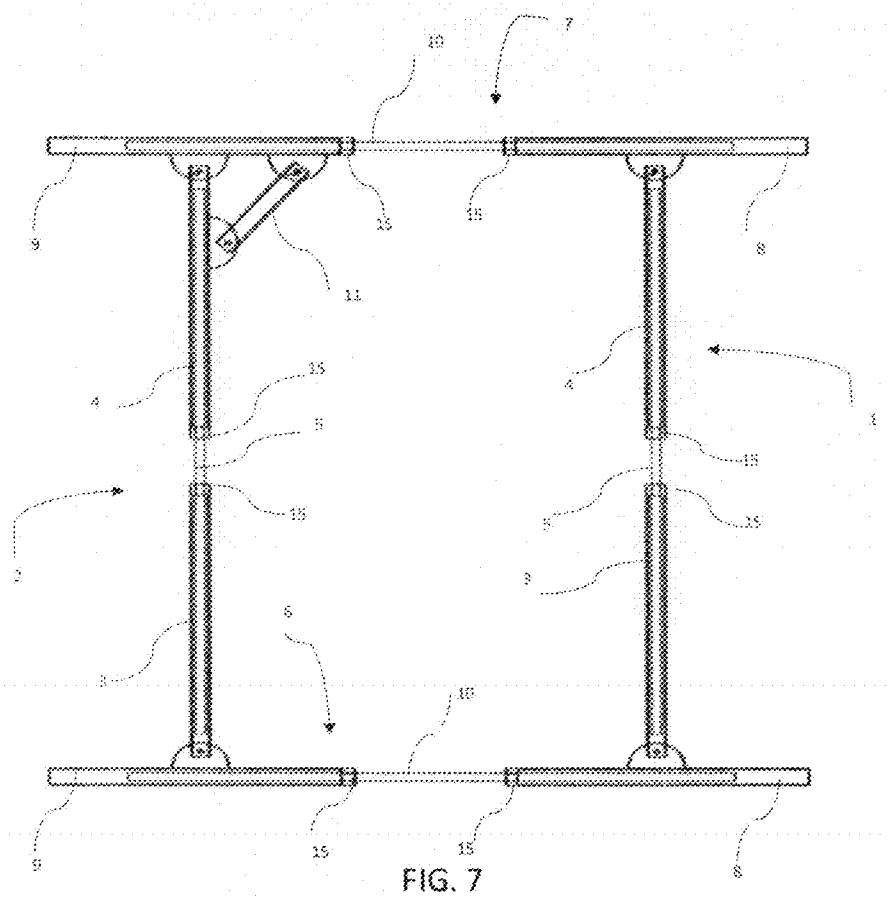

In reference to FIG. 3 and FIG. 5-6, the present invention further comprises a strut bod and a third locking body 14. The strut body 11 applies additional pressure to the second track brace 7 so that the present invention can maintain the rectangular profile without any deformation. More specifically, the strut body 11 is angularly positioned in between the second female tubular body 4 of the distal cross brace 2 and the distal female tubular body 9 of the second track brace 7. The strut body 11 being rotatably connected to the second female tubular body 4 of the distal cross brace 2 thus allowing the strut body 11 to be removably mounted to the distal female tubular body 9 of the second track brace 7. In other words, the strut body 11 is removably mounted to the distal female tubular body 9 of the second track brace 7 by the third locking body 14. Preferably, the third locking body 14 is a connector pin so that the user can easily remove the connector pin during an emergency to disassemble the present invention.

Although the invention has been explained in relation to its preferred embodiment, it is to be understood that many other possible modifications and variations can be made without departing from the spirit and scope of the invention as hereinafter claimed.

What is claimed is:

1. A window locking apparatus comprising:

a proximal cross brace;

a distal cross brace;

a first track brace;

a second track brace;

a strut body;

the proximal cross brace and the distal cross brace each comprising a first enclosed female tubular body and a second enclosed female tubular body;

the first track brace being positioned parallel to the second track brace;

the proximal cross brace being perpendicularly positioned in between the first track brace and the second track brace;

the first enclosed female tubular body of the proximal cross brace being rotatably connected to the first track brace via a hinge defined between a first pair of protruding tabs extending from the first track brace;

the second enclosed female tubular body of the proximal cross brace being rotatably connected to the second track brace via a hinge defined between a second pair of protruding tabs extending from the second track brace;

the distal cross brace being perpendicularly positioned in between the first track brace and the second track brace;

the first enclosed female tubular body of the distal cross brace being rotatably connected to the first track brace via a hinge defined between a third pair of protruding tabs extending from the first track brace;

the second enclosed female tubular body of the distal cross brace being rotatably connected to the second track brace via a hinge defined between a fourth pair of protruding tabs extending from the second track brace;

the proximal cross brace and the distal cross brace being positioned offset of each other;

the strut body being angularly positioned in between the second track brace and the second enclosed female tubular body of the distal cross brace;

the proximal cross brace and the distal cross brace each further comprising a threaded cross-rod;

the first enclosed female tubular body of each cross brace being threadedly engaged around a respective one of the threaded cross-rods;

the second enclosed female tubular body of each cross brace being threadedly engaged around the respective threaded cross-rod; and the first enclosed female tubular body and the second enclosed female tubular body of each cross brace being oppositely positioned of each other about the respective threaded cross-rod;

wherein the first track brace comprises a substantially planar bottom surface, such that the window locking apparatus is capable of standing upright on said bottom surface without support.

2. The window locking apparatus as claimed in claim 1 comprising:

the first track brace and the second track brace each comprising a proximal enclosed female tubular body, a distal enclosed female tubular body, and a threaded track-rod;

the proximal enclosed female tubular body of each track brace being threadedly engaged around a respective one of the threaded track-rods;

the distal enclosed female tubular body of each track brace being threadedly engaged around the respective threaded track-rod; and the proximal enclosed female tubular body and the distal enclosed female tubular body of each track brace being oppositely positioned of each other about the respective threaded track-rod.

3. The window locking apparatus as claimed in claim 1 comprising:

the first track brace and the second track brace each comprising a proximal enclosed female tubular body and a distal enclosed female tubular body, wherein:

the first pair of protruding tabs is provided on the proximal enclosed female tubular body of the first track brace;

the second pair of protruding tabs is provided on the proximal enclosed female tubular body of the second track brace;

the third pair of protruding tabs is provided on the distal enclosed female tubular body of the first track brace; and the fourth pair of protruding tabs is provided on the distal enclosed female tubular body of the second track brace.

4. The window locking apparatus as claimed in claim 3 comprising:

a first locking body, the first locking body connecting the second enclosed female tubular body of the proximal cross brace to the second pair of protruding tabs.

5. The window locking apparatus as claimed in claim 3 comprising:

a second locking body, the second locking body connecting the second enclosed female tubular body of the distal cross brace to the fourth pair of protruding tabs.

6. The window locking apparatus as claimed in claim 1, wherein:

the strut body is rotatably connected to a fifth pair of protruding tabs extending from the second track brace.

7. The window locking apparatus as claimed in claim 6 comprising:

a third locking body, the third locking body connecting the strut body to the fifth pair of protruding tabs.

8. A window locking apparatus comprising:

a proximal cross brace;

a distal cross brace;

a first track brace;

a second track brace;

a strut body;

the proximal cross brace and the distal cross brace each comprising a first enclosed female tubular body and a second enclosed female tubular body;

the first track brace being positioned parallel to the second track brace;

the proximal cross brace being perpendicularly positioned in between the first track brace and the second track brace;

the first enclosed female tubular body of the proximal cross brace being rotatably connected to the first track brace via a hinge defined between a first pair of protruding tabs extending from the first track brace;

the second enclosed female tubular body of the proximal cross brace being rotatably connected to the second track brace via a hinge defined between a second pair of protruding tabs extending from the second track brace;

the distal cross brace being perpendicularly positioned in between the first track brace and the second track brace;

the first enclosed female tubular body of the distal cross brace being rotatably connected to the first track brace via a hinge defined between a third pair of protruding tabs extending from the first track brace;

the second enclosed female tubular body of the distal cross brace being rotatably connected to the second track brace via a hinge defined between a fourth pair of protruding tabs extending from the second track brace;

the proximal cross brace and the distal cross brace being positioned offset of each other;

the strut body being angularly positioned in between the second track brace and the second enclosed female tubular body of the distal cross brace;

wherein the strut body is rotatably connected to a fifth pair of protruding tabs extending from the second track brace and the strut body is rotatably connected to a sixth pair of protruding tabs extending from the second enclosed female tubular body of the distal cross brace;

the proximal cross brace and the distal cross brace each further comprising a threaded cross-rod;

the first enclosed female tubular body of each cross brace being threadedly engaged around a respective one of the threaded cross-rods;

the second enclosed female tubular body of each cross brace being threadedly engaged around the respective threaded cross-rod; and the first enclosed female tubular body and the second enclosed female tubular body of each cross brace being oppositely positioned of each other about the respective threaded cross-rod;

wherein the first track brace comprises a substantially planar bottom surface, such that the window locking apparatus is capable of standing upright on said bottom surface without support.

9. The window locking apparatus as claimed in claim 8 comprising:

the first track brace and the second track brace each comprising a proximal enclosed female tubular body, a distal enclosed female tubular body, and a threaded track-rod;

the proximal enclosed female tubular body of each track brace being threadedly engaged around a respective one of the threaded track-rods;

the distal enclosed female tubular body of each track brace being threadedly engaged around the respective threaded track-rod; and the proximal enclosed female tubular body and the distal enclosed female tubular body of each track brace being oppositely positioned of each other about the respective threaded track-rod.

10. The window locking apparatus as claimed in claim 8 comprising:

the first track brace and the second track brace each comprising a proximal enclosed female tubular body and a distal enclosed female tubular body, wherein:

the first pair of protruding tabs is provided on the proximal enclosed female tubular body of the first track brace;

the second pair of protruding tabs is provided on the proximal enclosed female tubular body of the second track brace;

the third pair of protruding tabs is provided on the distal enclosed female tubular body of the first track brace; and the fourth pair of protruding tabs is provided on the distal enclosed female tubular body of the second track brace.

11. The window locking apparatus as claimed in claim 10 comprising:

a first locking body, the first locking body connecting the second enclosed female tubular body of the proximal cross brace to the second pair of protruding tabs.

12. The window locking apparatus as claimed in claim 10 comprising:

a second locking body, the second locking body connecting the second enclosed female tubular body of the distal cross brace to the fourth pair of protruding tabs.

13. The window locking apparatus as claimed in claim 8 comprising:

a third locking body, the third locking body connecting the strut body to the fifth pair of protruding tabs.

* * * * *